US012760980B2

(12) United States Patent
Elftmann, Jr.

(10) Patent No.: US 12,760,980 B2
(45) Date of Patent: Oct. 13, 2026

(54) SKIPLESS TRIGGER SYSTEMS AND METHODS

(71) Applicant: Arthur J. Elftmann, Jr., Glendale, AZ (US)

(72) Inventor: Arthur J. Elftmann, Jr., Glendale, AZ (US)

( * ) Notice: Subject to any disclaimer, the term of this patent is extended or adjusted under 35 U.S.C. 154(b) by 0 days.

(21) Appl. No.: 18/953,621

(22) Filed: Nov. 20, 2024

(65) Prior Publication Data

US 2025/0164204 A1 May 22, 2025

Related U.S. Application Data

(60) Provisional application No. 63/601,608, filed on Nov. 21, 2023.

(51) Int. Cl.
*F41A 19/32* (2006.01)
*F41A 17/56* (2006.01)
*F41A 19/45* (2006.01)

(52) U.S. Cl.
CPC ..... *F41A 19/45* (2013.01); *F41A 17/56* (2013.01); *F41A 19/32* (2013.01)

(58) Field of Classification Search
CPC ..... F41A 19/30; F41A 19/31; F41A 19/32; F41A 17/56
See application file for complete search history.

(56) References Cited

U.S. PATENT DOCUMENTS 1,143,470 A * 6/1915 Whiting ..... F41A 17/36 89/137
1,143,471 A * 6/1915 Whiting ..... F41A 17/36 89/137
2,296,998 A * 9/1942 Koehler ..... F41A 17/36 89/137
5,086,578 A * 2/1992 Lishness ..... F41A 19/32 42/69.02
5,386,659 A * 2/1995 Vaid ..... F41A 19/32 42/69.02
5,640,794 A * 6/1997 Gardner ..... F41A 19/35 42/69.02
5,906,066 A * 5/1999 Felk ..... F41A 11/02 42/69.02
6,308,448 B1 * 10/2001 Kapusta ..... F41A 19/31 42/69.02
7,194,833 B1 * 3/2007 Curry ..... F41A 19/31 42/16
7,827,720 B1 * 11/2010 Erdem ..... F41A 17/42 42/70.08
10,234,225 B2 * 3/2019 Zukowski ..... F41A 17/20
2011/0289811 A1 * 12/2011 Gentilini ..... F41A 19/35 42/69.02
2013/0174460 A1 * 7/2013 Aigner ..... F41A 19/12 42/69.01
2015/0292828 A1 * 10/2015 Nebeker ..... F41A 17/46 42/69.01

(Continued)

FOREIGN PATENT DOCUMENTS

DE 102005020823 B3 * 8/2006 ..... F41A 19/31

*Primary Examiner* — Gabriel J. Klein
(74) *Attorney, Agent, or Firm* — The Law Offices of Lisa & Lesko, LLC; Justin J. Lesko, Esq.

(57) ABSTRACT

A non-skip trigger for a sliding weapon including a spring-loaded pivot arm, spring loaded disconnector, and spring-loaded firing pin release that fit together to prevent automatic firing of the weapon.

1 Claim, 18 Drawing Sheets

(56) References Cited

U.S. PATENT DOCUMENTS

| | | | | |
|---|---|---|---|---|
| 2017/0184366 | A1* | 6/2017 | Zajk | F41A 19/15 |
| 2017/0227310 | A1* | 8/2017 | Gorza | F41C 3/00 |
| 2018/0187994 | A1* | 7/2018 | Carr | F41A 19/30 |
| 2022/0373283 | A1* | 11/2022 | Fife | F41A 19/31 |
| 2022/0397359 | A1* | 12/2022 | Velasquez | F41A 19/31 |

* cited by examiner

SKIPLESS TRIGGER SYSTEMS AND METHODS

BACKGROUND OF THE INVENTION

Field of the Invention

Described herein are trigger systems for weapons, such as Glock-style pistols and AR-15 rifles. The trigger systems improve existing trigger systems because they reliably fire every time but never "skip" (i.e., misfire or fire continuously like an automatic weapon) as a result of trigger fluttering or other issues. The trigger systems make the guns safer to use and prevents gun owners from facing liability for carrying or using an automatic weapon, which is illegal for most citizens in the United States and in other countries.

Description of Known Art

Examples of existing trigger systems for a Glock can be found in U.S. Pat. No. 9,316,455, incorporated by reference herein. Examples of existing AR-15 triggers can be found for example in U.S. Pat. No. 11,796,270, incorporated by reference herein.

SUMMARY

The trigger systems described below improve existing trigger systems because they reliably fire every time but never "skip" (i.e., misfire or fire continuously like an automatic weapon) as a result of trigger fluttering or other issues. The components are sized and positioned such that "fluttering" of the trigger does not matter—after firing, the weapon will not be ready to fire again unless the user releases the trigger. Furthermore, the system described herein feels better and is more reliable than a standard Glock trigger system, which uses flimsy components to catch and pull back the firing pin. The trigger systems described below have a "dual-adjustment" capability—a user can adjust both the trigger pull force and the tightness of the firing sear to desired settings, which is very useful in competition and other settings.

Objects and advantages pertaining to the trigger may become apparent upon referring to the example embodiments illustrated in the drawings and disclosed in the following written description or appended claims.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112, ¶6. Thus, the use of the words "function," "means" or "step" in the Detailed Description or Description of the Drawings or claims is not intended to somehow indicate a desire to invoke the special provisions of 35 U.S.C. § 112, ¶6, to define the invention. To the contrary, if the provisions of 35 U.S.C. § 112, ¶6 are sought to be invoked to define the inventions, the claims will specifically and expressly state the exact phrases "means for" or "step for and will also recite the word "function" (i.e., will state "means for performing the function of [insert function]"), without also reciting in such phrases any structure, material or act in support of the function. Thus, even when the claims recite a "means for performing the function of . . . "or "step for performing the function of . . . ," if the claims also recite any structure, material or acts in support of that means or step, or that perform the recited function, then it is the clear intention of the inventors not to invoke the provisions of 35 U.S.C. § 112, ¶6. Moreover, even if the provisions of 35 U.S.C. § 112, ¶6 are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

BRIEF DESCRIPTION OF THE DRAWINGS

A more complete understanding of the present invention may be derived by referring to the detailed description when considered in connection with the drawing figures wherein.

Figure 1:
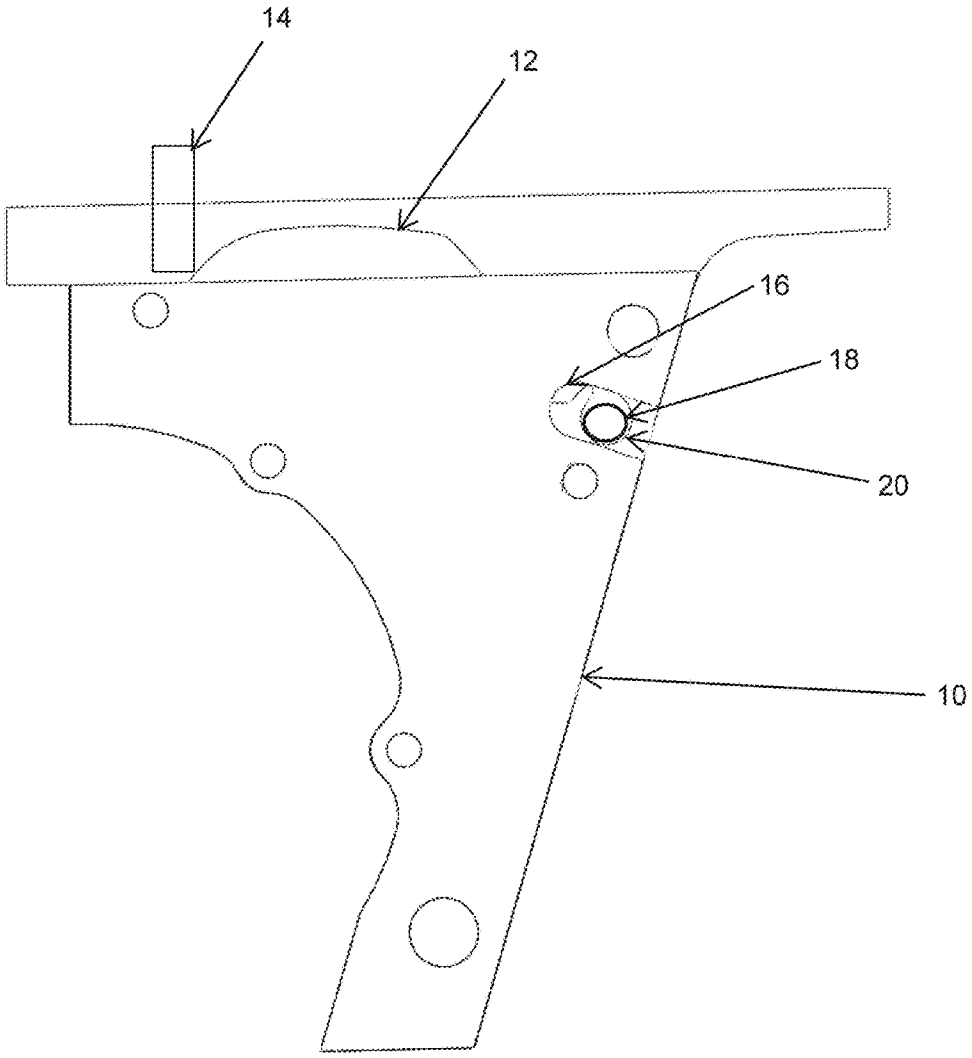
FIG. 1 is a side view of the first example, including the trigger housing cover 10.
Figure 2:
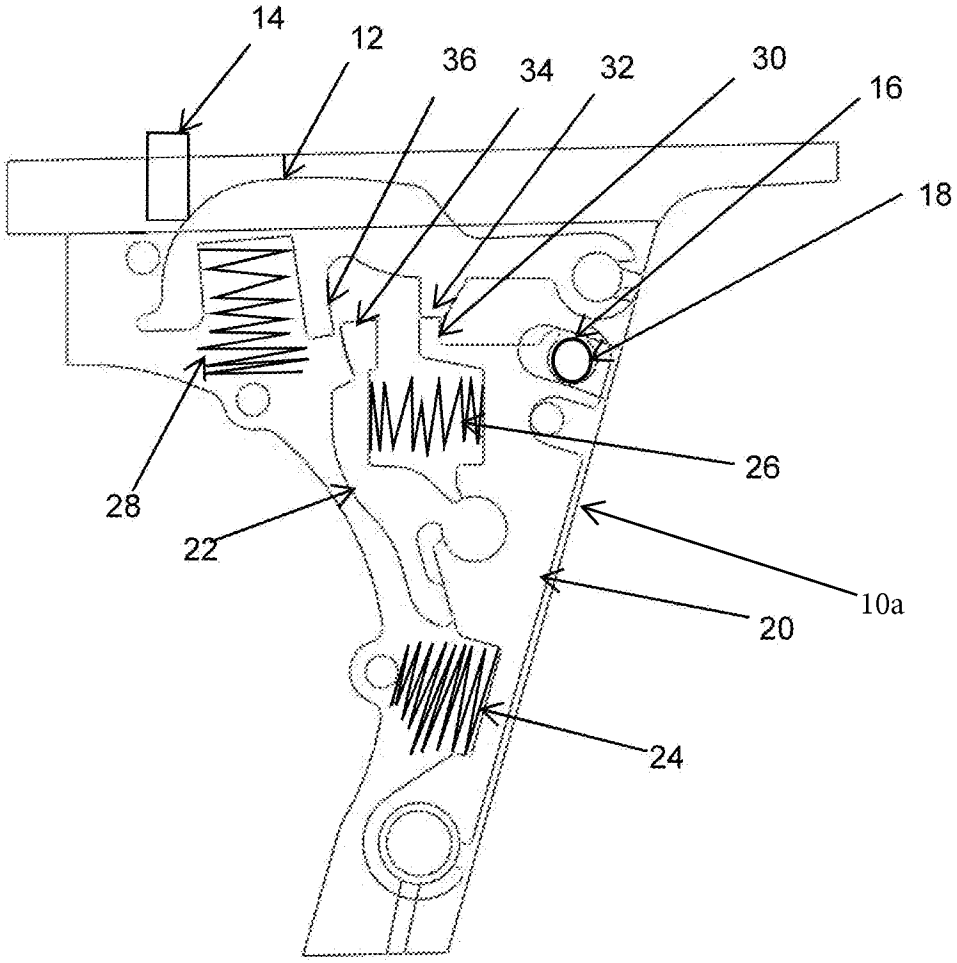
FIG. 2 is a side view of the first example, with the trigger housing cover 10 shown as invisible and the system components shown within the trigger housing 10*a;*

Elements and acts in the figures are illustrated for simplicity and have not necessarily been rendered according to any particular sequence or embodiment.

Embodiments depicted are shown only schematically, and not all features may be shown in full detail or in proper proportion. Certain features or structures may be exaggerated relative to others for clarity. The embodiments shown are examples only, and should not be construed as limiting the scope of the present disclosure or appended claims.

DETAILED DESCRIPTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the invention is not limited to the examples that are described below.

FIG. 1-9 show an example of a non-skip trigger mechanism for a Glock-type sliding pistol. The example shown in FIGS. 1-9 comprises (inter alia) the following elements: (1) trigger housing cover 10 to cover trigger housing 10*a*, (2) firing pin release 12 including protrusion 32 and protrusion 36, (3) a firing pin 14, (4) a slot 16, (5) a pin/spacer 18, (6) a pivot arm 20 including protrusion 30, (7) a disconnector 22 including protrusion 34, (8) springs 24, 26, and 28, (9) linkage 40, and (10) trigger shoe 42.

FIGS. 3-6 show the various positions of the trigger mechanism before firing, during firing, and after the weapon is fired.

Figure 3:
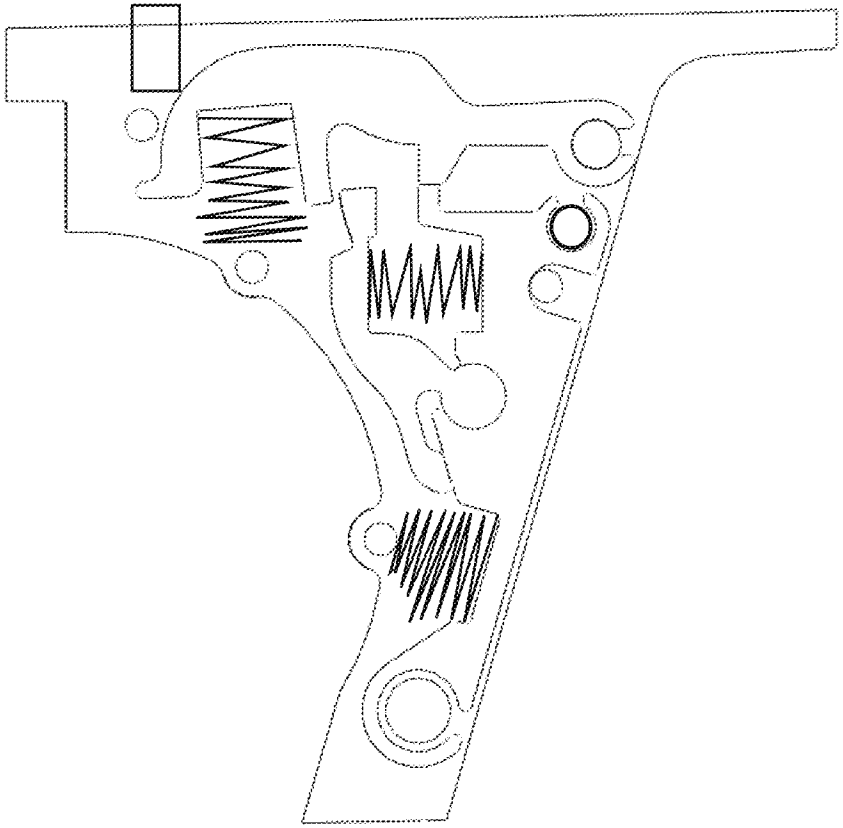
FIG. 3 shows the position of the system components when a bullet is in the chamber of the Glock-type sliding pistol and the slide release has been engaged, but before the trigger has been pulled.

FIG. 3 shows the position of the system components when a bullet is in the chamber of the Glock-type sliding pistol and the slide release has been engaged, but before the trigger has been pulled. In other words, the positions of the components shown in FIG. 3 represent the position when the gun is ready to be fired but has not yet been fired.

As shown in FIG. 3, the firing pin 14 is engaged with the firing pin release 12. A spring force is pressing the firing pin 14 against the firing pin release 12. The gun does not fire because the protrusion 32 of firing pin release 12 is pressed against the protrusion 30 of pivot arm 20, prevent movement of the firing pin release 12.

Figure 4:
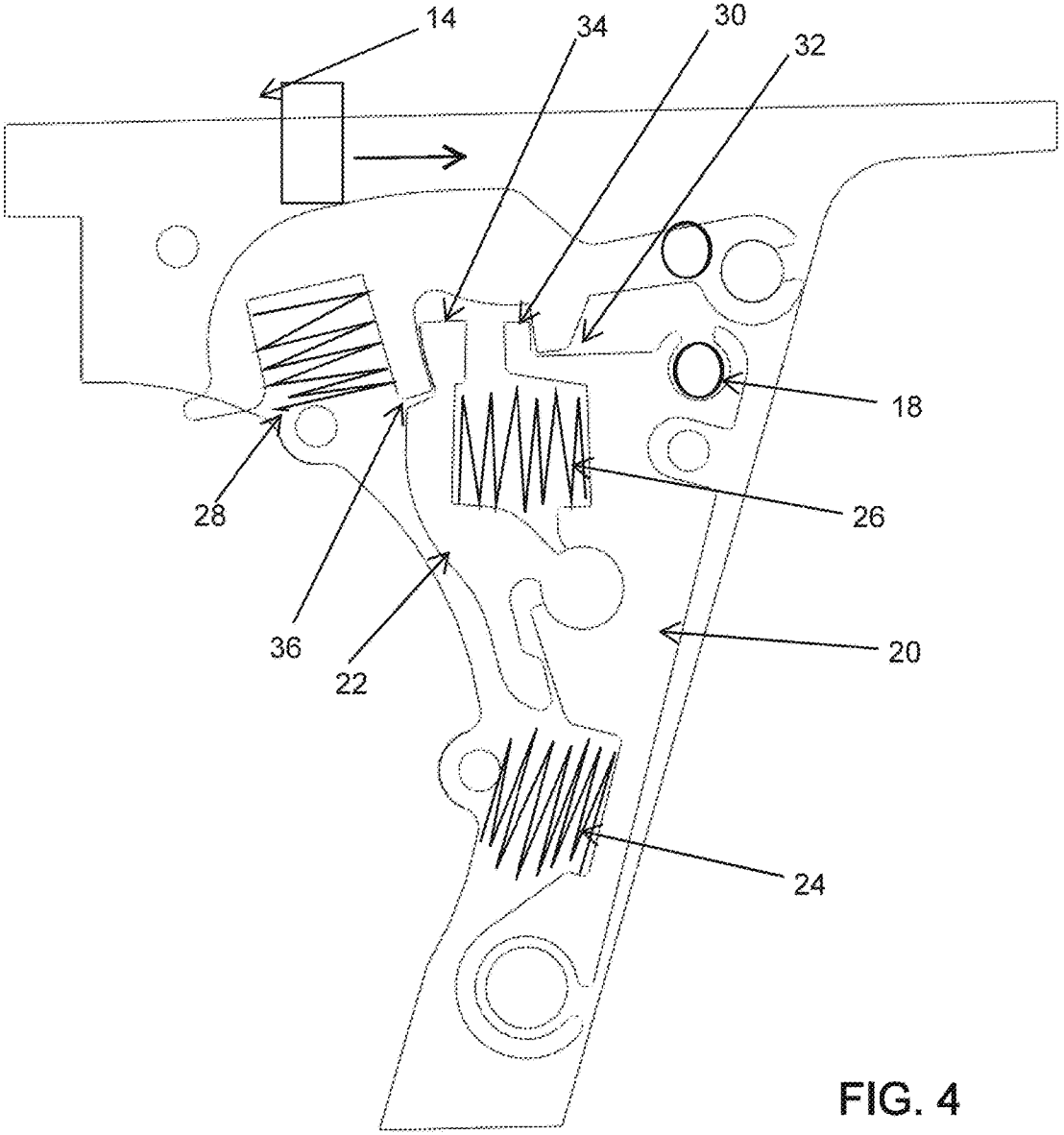
FIG. 4 is a side view of the first example, showing the position of the system components as the trigger gets pulled to fire the weapon.

FIG. 4 shows the position of the system components as the trigger gets pulled to fire the weapon. When a user pulls the trigger 42, it correspondingly moves the linkage 40, which causes the pin/spacer 18 to be pulled back within the slot 16, away from the front of the weapon. The movement of pin/spacer 18 causes the pivot arm 20 to also be pulled back. At a certain point in the trigger pulling process, the protrusion 32 slips off of the protrusion 30, which causes the firing pin release 12 to move downward as a result of the force exerted by the spring-loaded firing pin 14. When the firing pin release 12 moves downward, the protrusions 30 and 34 fall into the position shown in FIG. 4, and the firing pin 14 is released past the firing pin release 12 to fire the weapon. FIG. 4 is a representation of the respective positions of the components around the time that firing occurs. FIG. 4 also shows, with an arrow, the direct of movement of the firing pin to fire the weapon.

Figure 5:
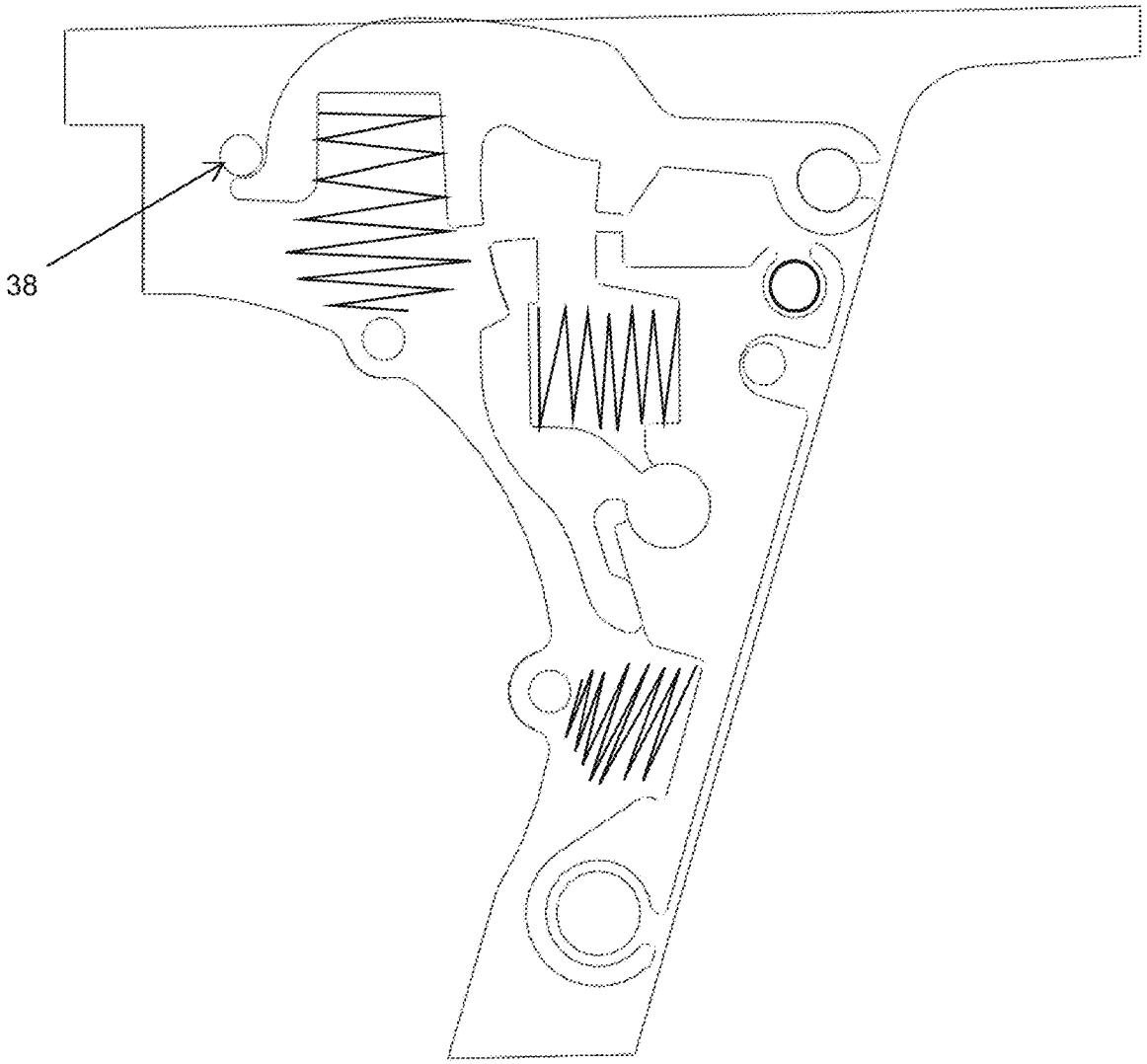
FIG. 5 is a side view of the first example, showing the positions of the system components after the slider and firing pin 14 recoil back past the firing pin release 12 and before a user has released the trigger.

After the weapon is fired, the slider of the weapon, including the firing pin 14, recoils back, as is known in the art. See, e.g., https://www.youtube.com/watch?v=V2RDitgCaD0 (YouTube video titled "How a Glock works" by Matt Rittman, dated Jul. 2, 2019). FIG. 5 shows the positions of the system components after the slider and firing pin 14 recoil back past the firing pin release 12. At the point of the process shown in FIG. 5, a user has not released the trigger. As shown in FIG. 5, without the firing pin 14 engaging with the firing pin release 12, the firing pin release 12 becomes fully extended but stopped by the pin 38.

Figure 6:
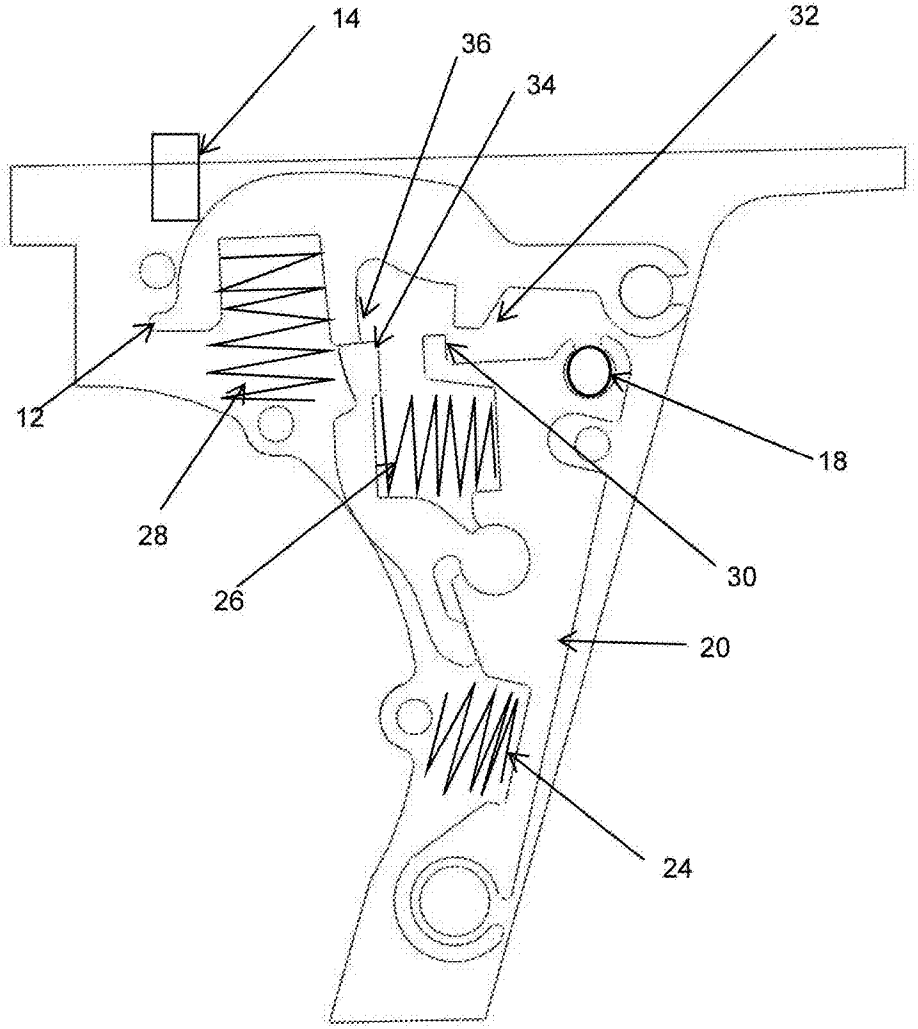
FIG. 6 is a side view of the first example, showing the position of the system components after the weapon has been fired and after the process of recoiling the slider is complete, but before the user releases the trigger.

FIG. 6 shows the position of the system components after the weapon has been fired and after the process of recoiling the slider is complete, but before the user releases the trigger. As shown in FIG. 6, the contact between protrusion 36 and protrusion 34 prevents movement of the firing pin release 12, which stops the firing pin 14 from automatically firing again. In this way, the weapon using the trigger system is not automatic. In order to fire another round, the user must let go of the trigger, which causes pin/spacer 18, pivot arm 20, and disconnector 22 to all move forward toward the front of the gun. As this happens, protrusion 30 engages with protrusion 32 and protrusion 34 slips to the inside of protrusion 36, bringing the components back to the start position shown in FIG. 3.

Figure 7:
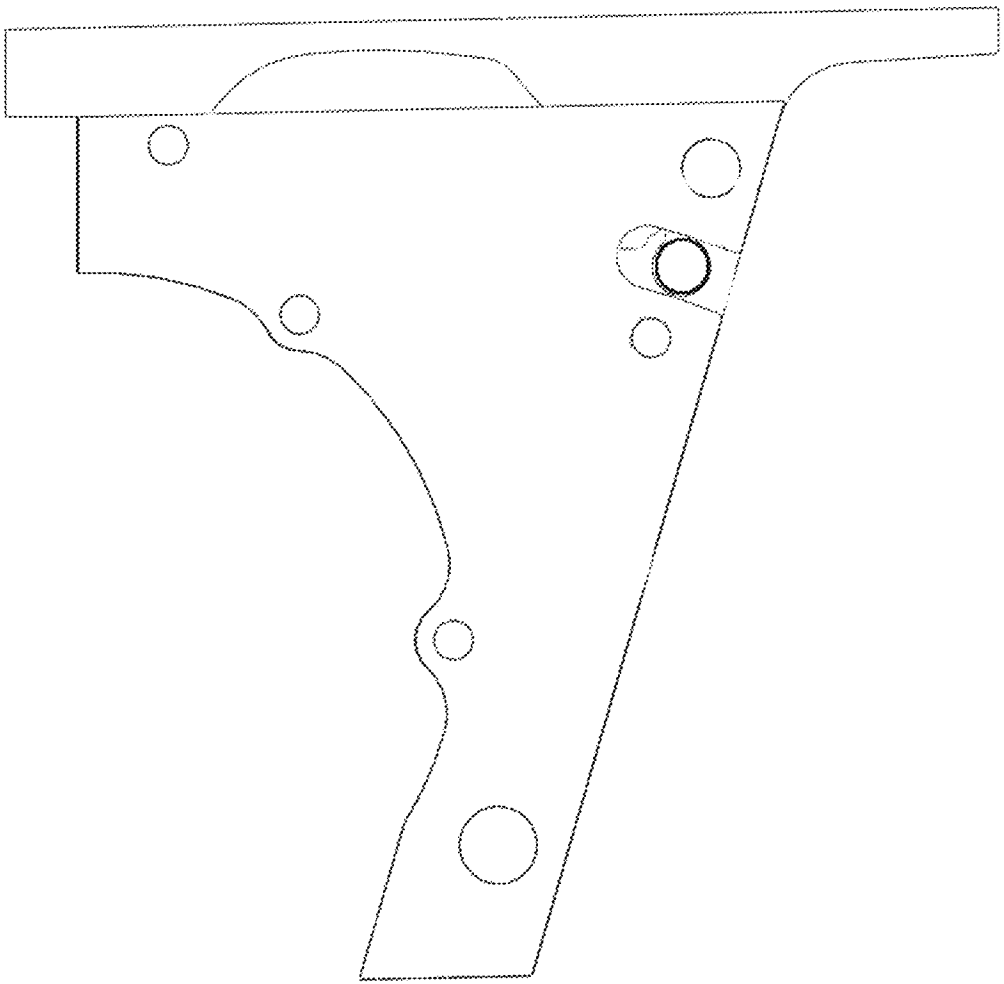
FIG. 7 is a picture of the first example.

FIG. 7 is a picture of the system corresponding to FIG. 1.

Figure 8:
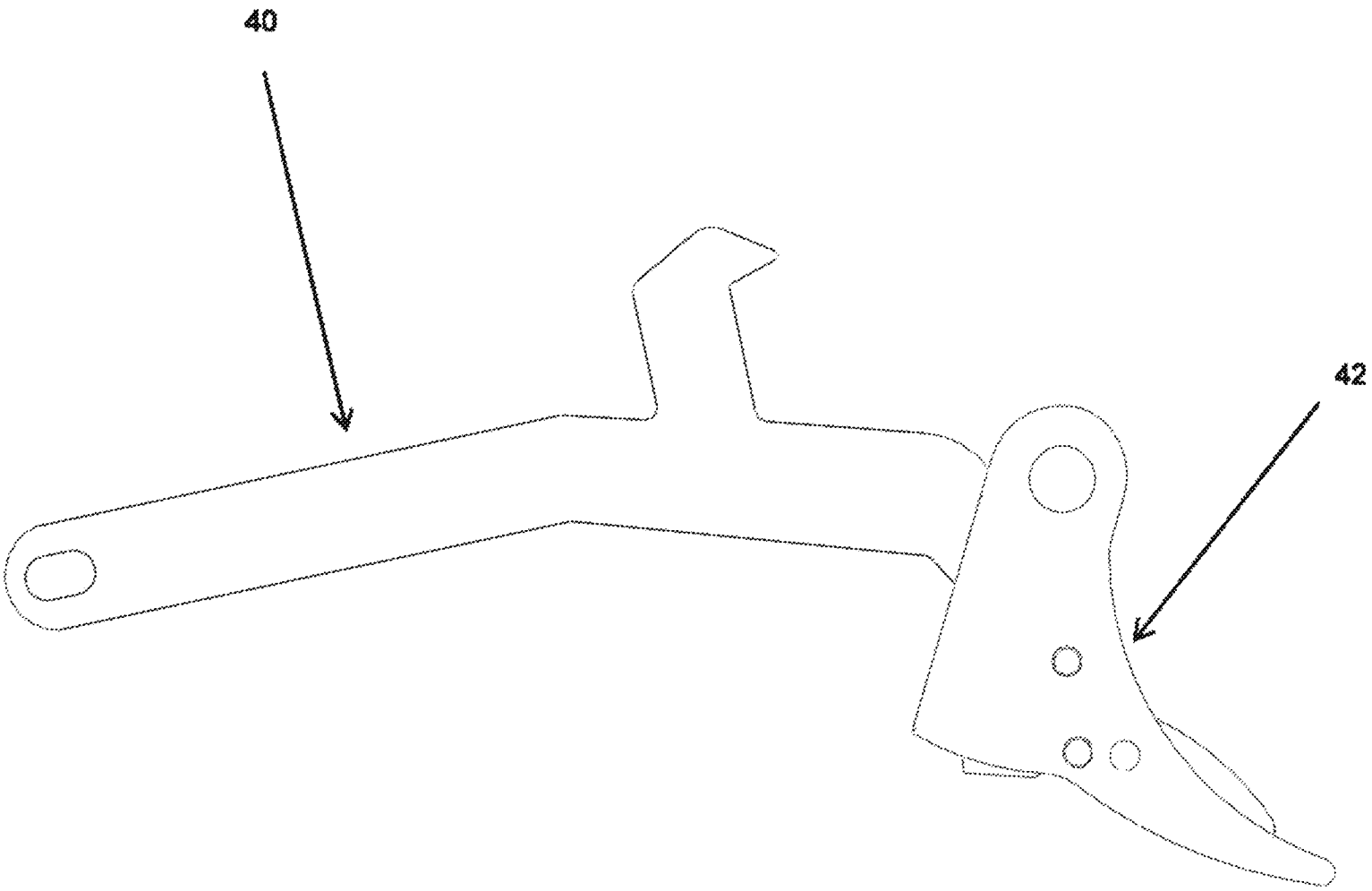
FIG. 8 is a side view of the first example, showing the linkage 40 and trigger shoe 42, which would be interconnected by a bolt through slot 44.

FIG. 8 shows the linkage 40 and trigger shoe 42, which would be interconnected by a bolt through slot 44.

Figure 9:
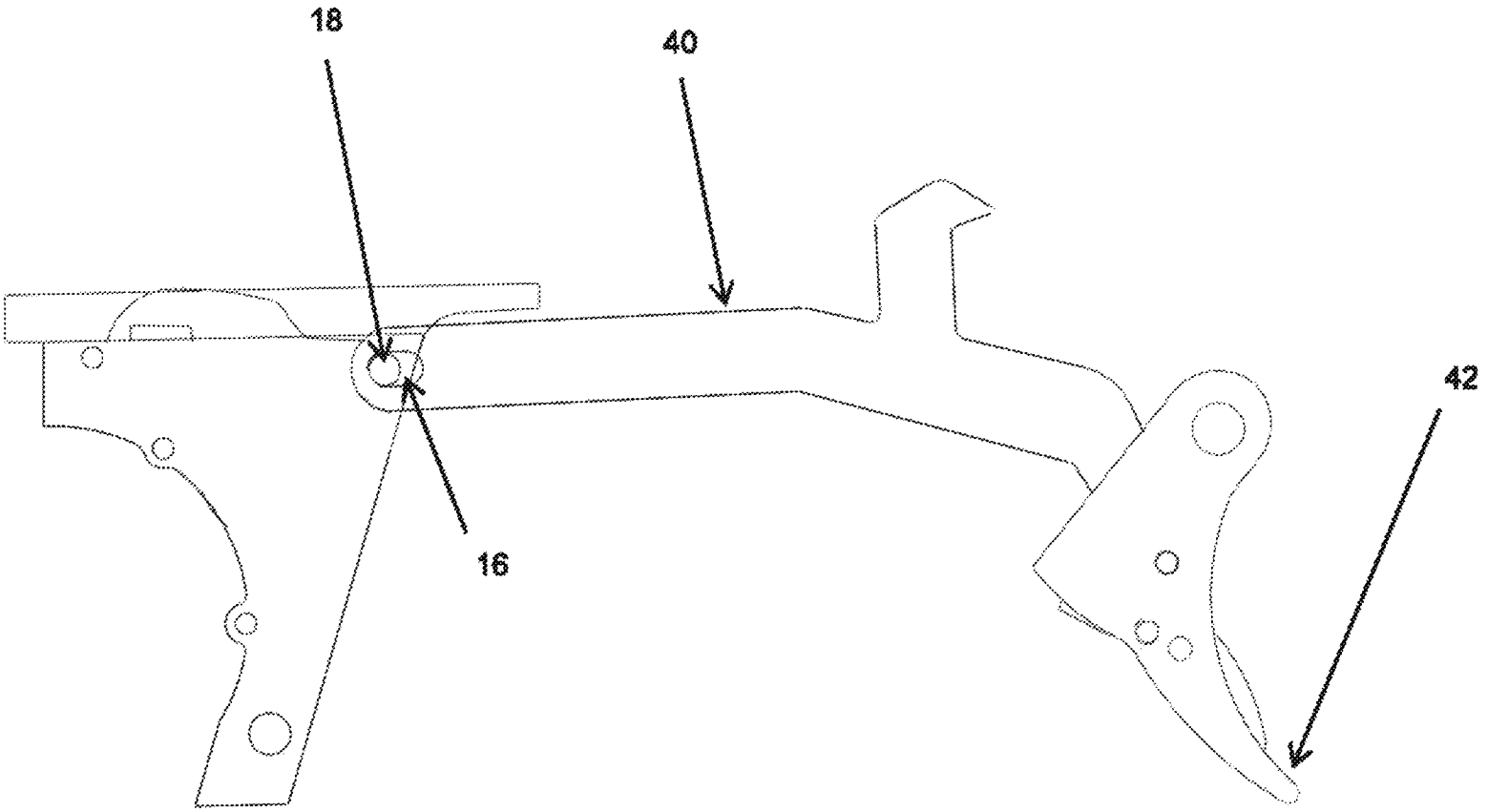
FIG. 9 is a side view of the first example, showing linkage 40 placed over the pin/spacer 18 via slot 46, which is how the two components would be interconnected within a weapon.

FIG. 9 shows the linkage 40 and trigger shoe 42. In FIG. 9, linkage 40 is placed over the pin/spacer 18 via slot 46, which is how the two components would be interconnected within a weapon. When the assembly shown in FIG. 9 is in a weapon, the pin/spacer 18 is used to connect the system to the linkage 40 and it also acts as a spacer between the wall of the weapon to keep the linkage 40 in place.

The components are sized and positioned such that "fluttering" of the trigger does not matter—after firing, the weapon will not be ready to fire again (i.e., in the start position of FIG. 3) unless the user releases the trigger.

Furthermore, the system shown in FIG. 1-9 feels better and is more reliable than a standard Glock trigger system, which uses flimsy components to catch and pull back the firing pin. See, e.g., https://www.youtube.com/watch?v=V2RDitgCaD0 (YouTube video titled "How a Glock works" by Matt Rittman, dated Jul. 2, 2019).

FIGS. 10-18 show a trigger system for an AR-15 or similar rifle. The example shown in FIGS. 10-18 comprises (inter alia) the following elements: (1) trigger shoe 50, (2) hammer 52 including protrusions 54 and 56, (3) firing sear 58 including protrusion 60, (4) disconnector 62 including protrusion 64, (5) spring 66, (6) adjustable screw 68, (7) spring 70, and (8) adjustable screw 72.

Figure 10:
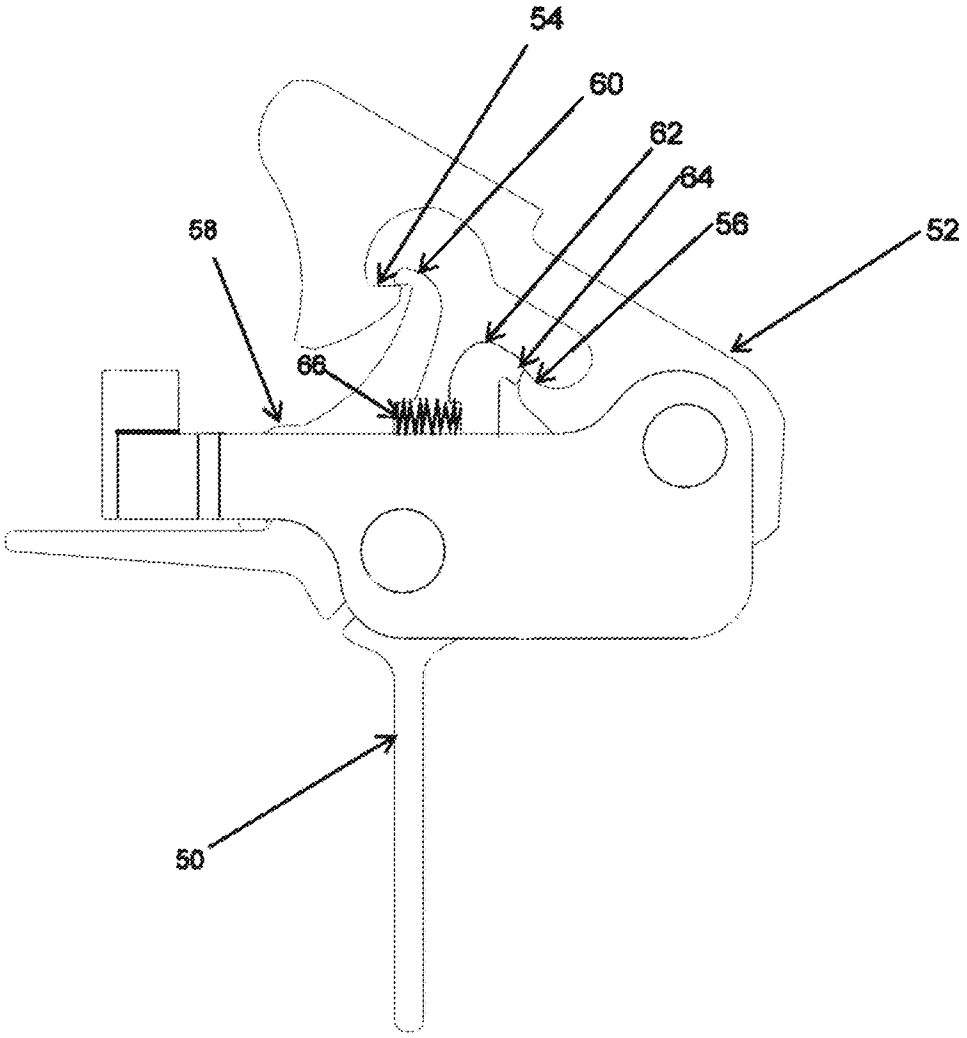
FIG. 10 is a side view of the second example, showing the trigger system components in the ready to fire position, before the trigger shoe 50 is pulled.
Figure 11:
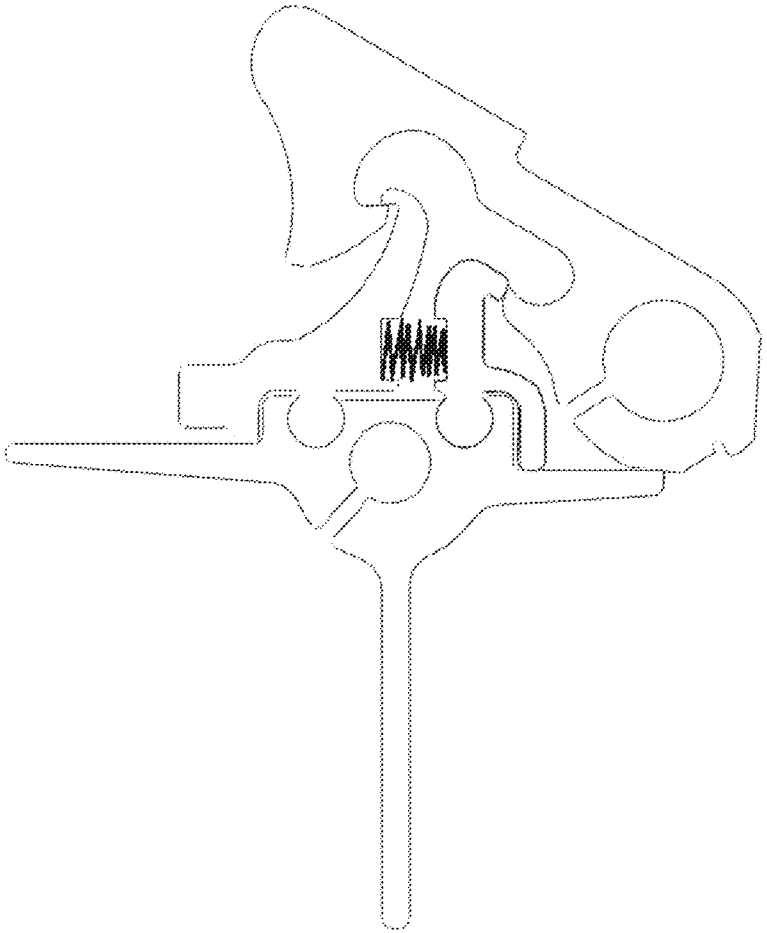
FIG. 11 is a side view of the second example, showing the trigger system components in the ready to fire position, before the trigger shoe 50 is pulled.
Figure 12:
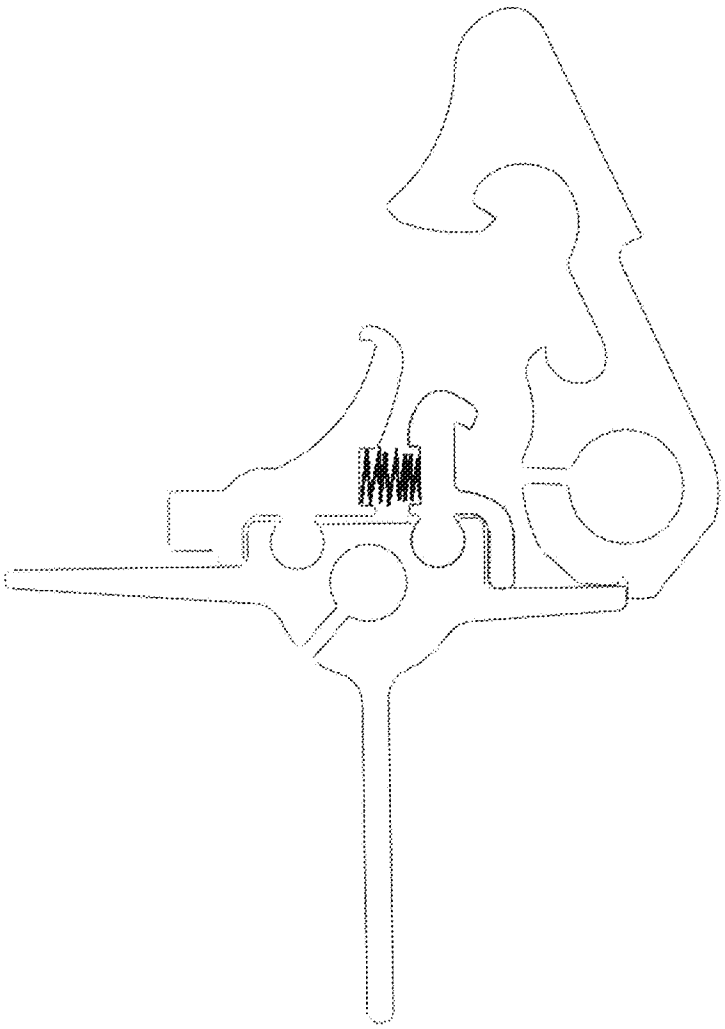
FIG. 12 is a side view of the second example, showing the trigger system at the point in time when the weapon is fired, with the released hammer 52 striking the firing pin (not shown) to fire the weapon.

FIGS. 10 and 11 show the trigger system components in the ready to fire position, before the trigger shoe 50 is pulled. As shown, the protrusion 60 of firing sear 58 is engaged with the protrusion 54 of hammer 52 to prevent the weapon from firing. When the trigger shoe 50 is pulled, it causes the firing sear 58 and protrusion 60 to move forward, toward the front of the weapon, and eventually, the trigger is pulled sufficiently to cause the protrusion 60 to release protrusion 54 of hammer 52. At that point in the process, the spring force pulling on hammer 52 causes hammer 52 to spring forward to fire the weapon. FIG. 12 shows the trigger system at the point in time when the weapon is fired, with the released hammer 52 striking the firing pin (not shown) to fire the weapon.

When the weapon is fired the bolt carrier returns the hammer 52 to its cocked position. See, e.g., https://www.youtube.com/watch?v=omv58cLfmxU (YouTube video titled "How an AR-15 Works" by Matt Rittman, dated Aug. 10, 2022).

Figure 13:
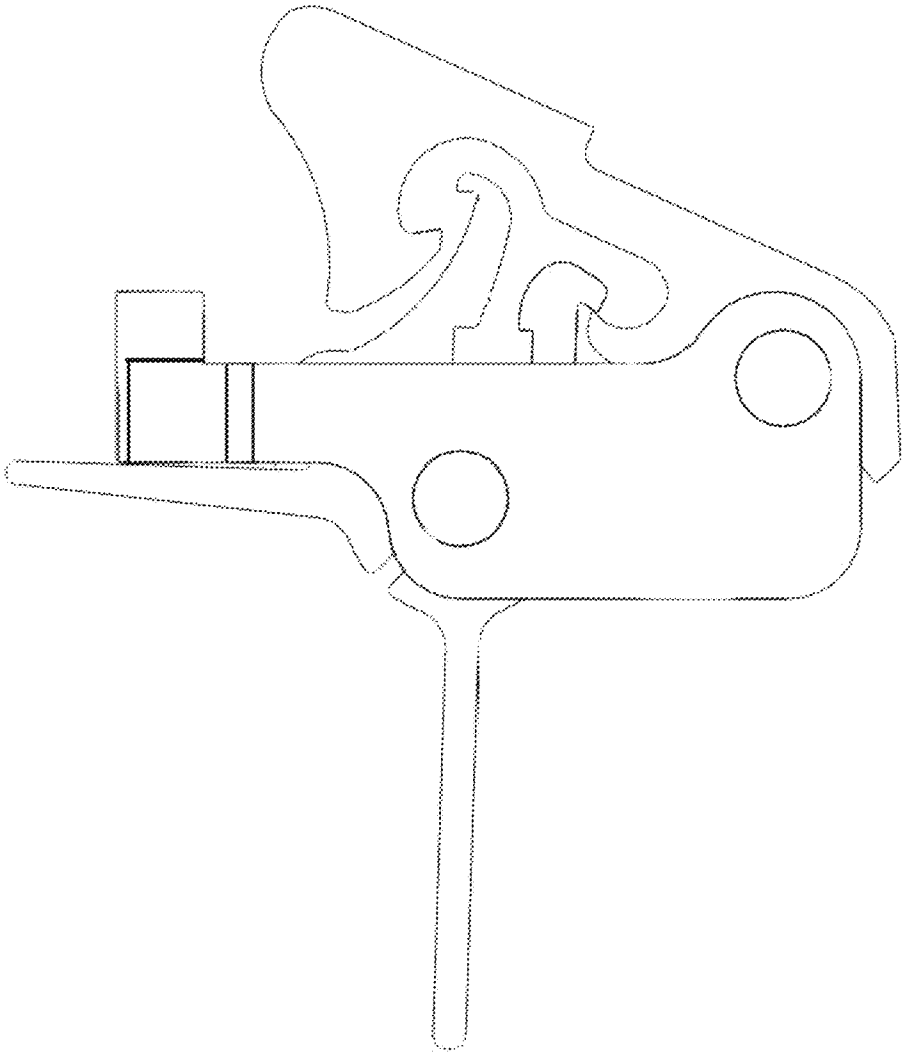
FIG. 13 is a side view of the second example, showing protrusion 64 of disconnector 62 engaged with protrusion 56 of hammer 52 when the user is still holding the trigger shoe 50 after firing a round.

At that time, if the user is still holding the trigger shoe 50 in the position that was used to fire the gun, protrusion 64 of disconnector 62 will engage with protrusion 56 of hammer 52, thereby preventing the hammer from firing while the trigger shoe 50 is still pulled back from firing the prior round of ammunition. In this way, the trigger system cannot be used as an automatic weapon. FIG. 13 shows protrusion 64 of disconnector 62 engaged with protrusion 56 of hammer 52 when the user is still holding the trigger shoe 50 after firing a round.

When the user releases the trigger shoe 50, the protrusion 64 of disconnector 62 will disengage from protrusion 56 of hammer 52, but at the same time, the protrusion 60 of firing sear 58 engages with the protrusion 54 of hammer 52 to prevent the weapon from firing. The system will then be back in the position shown in FIG. 10.

The components are sized and positions such that "fluttering" of the trigger does not matter—after firing, the weapon will not be ready to fire again (i.e., in the start position of FIG. 10) unless the user releases the trigger.

Furthermore, the system shown in FIGS. 10-18 feels better and is more reliable than a standard AR-15 trigger system.

Figure 14:
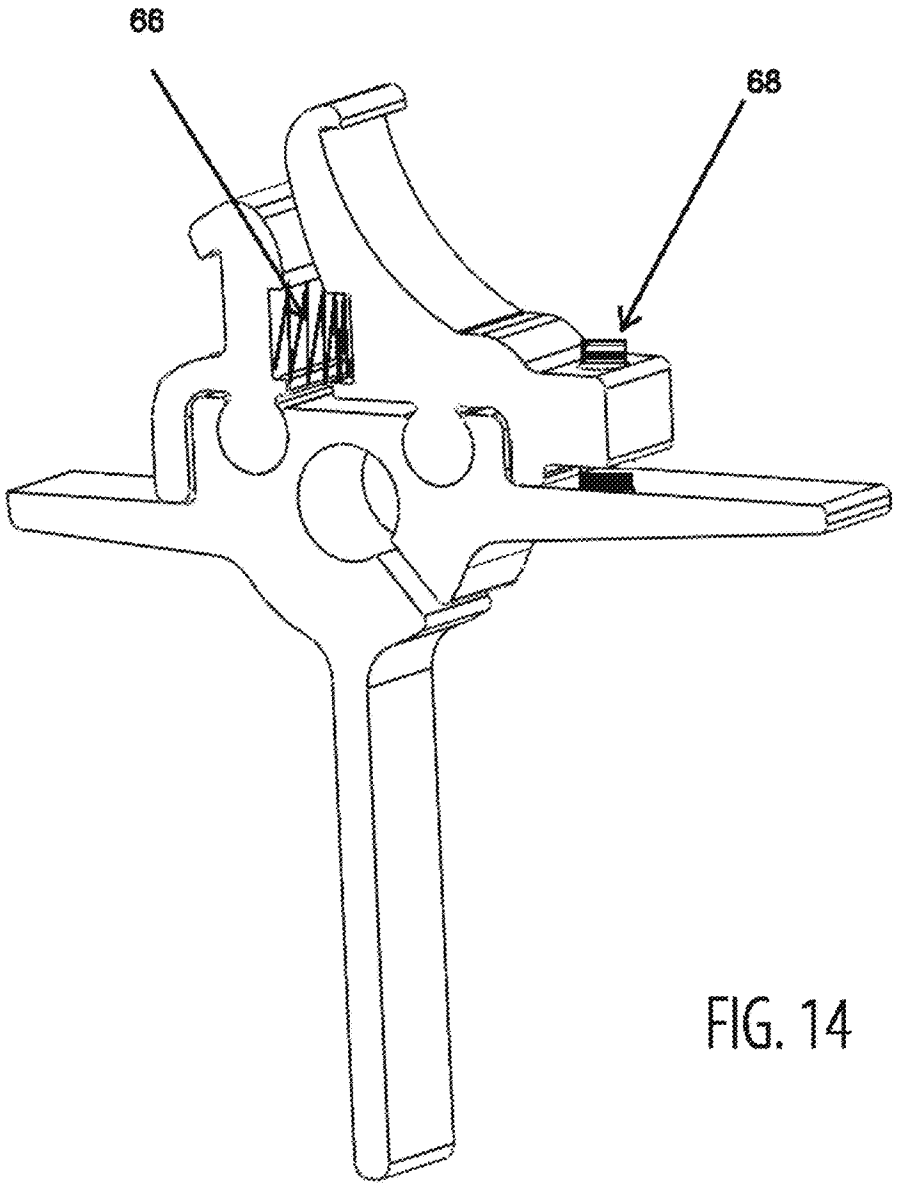
FIG. 14 is an isometric view of the second example, showing the adjustable screw 68 for controlling the tightness with which the protrusion 60 of firing sear 58 engages with the protrusion 54 of hammer 52 to prevent the weapon from firing.
Figure 15:
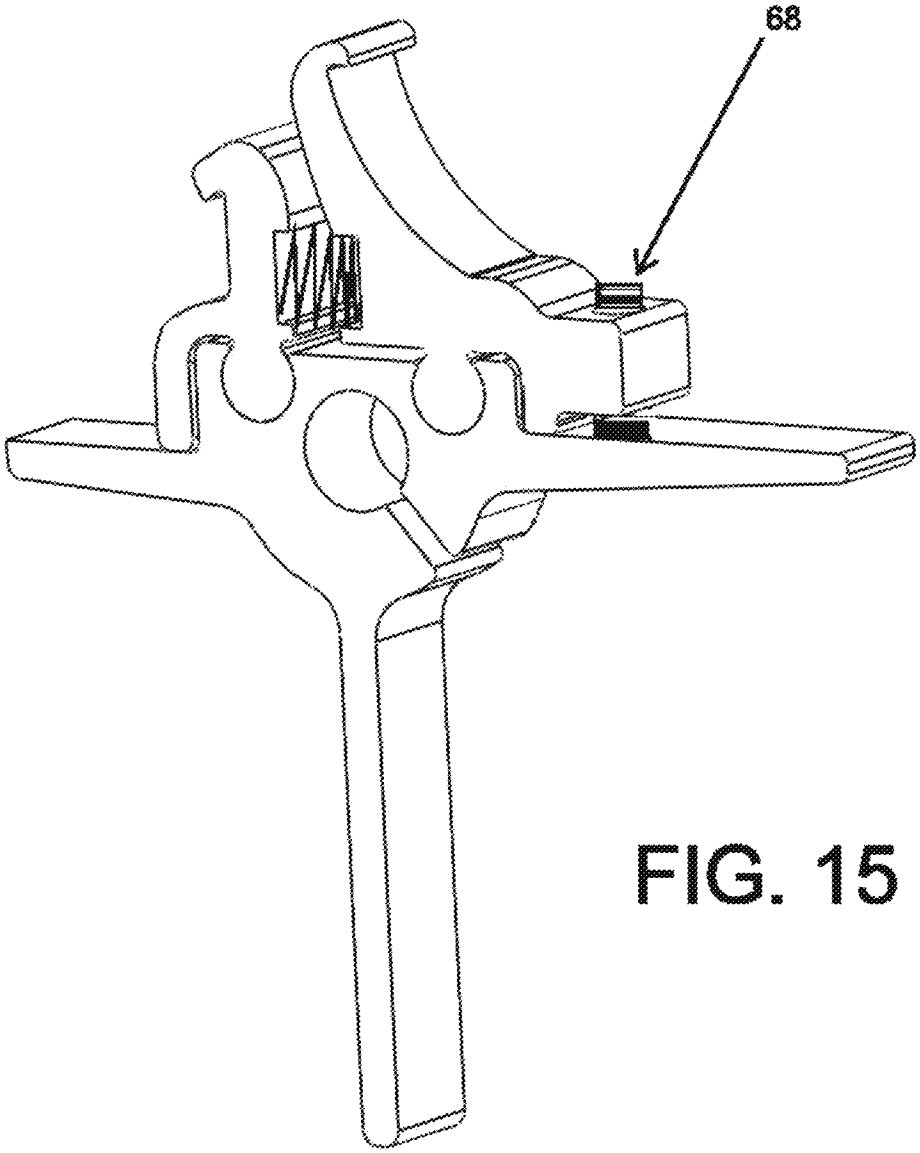
FIG. 15 is an isometric view of the second example, showing the adjustable screw 68 for controlling the tightness with which the protrusion 60 of firing sear 58 engages with the protrusion 54 of hammer 52 to prevent the weapon from firing.
Figure 16:
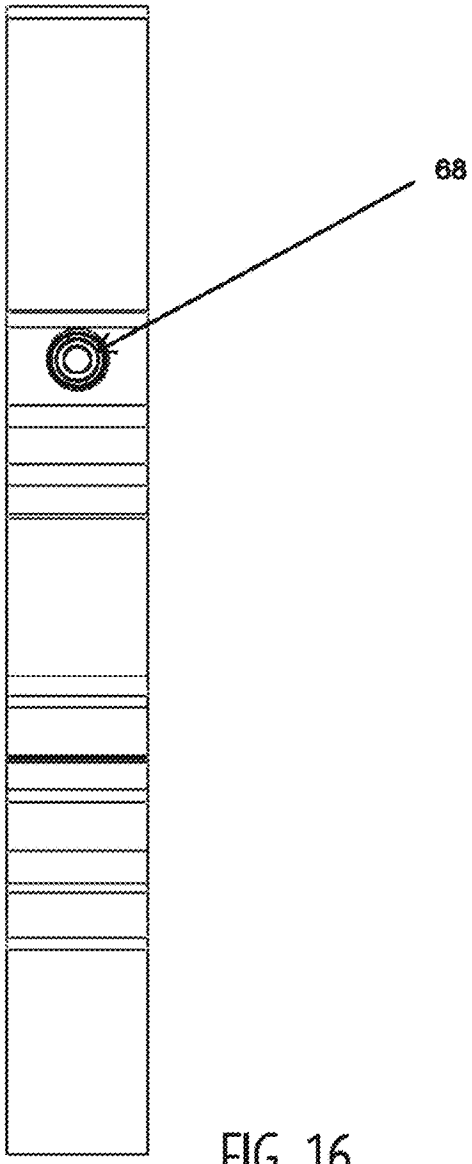
FIG. 16 is a top view of the second example, showing the adjustable screw 68 for controlling the tightness with which the protrusion 60 of firing sear 58 engages with the protrusion 54 of hammer 52 to prevent the weapon from firing.

In addition, the system shown in FIGS. 10-18 has a "dual-adjustment" capability that is absent from most AR-15 or comparable triggers. First, the user can control the tightness with which the protrusion 60 of firing sear 58 engages with the protrusion 54 of hammer 52 to prevent the weapon from firing. A simple adjustable screw 68 (in the example, a set screw) is used to make such adjustments, as shown in FIGS. 14, 15, and 16. As the adjustable screw 68 is tightened to push on the firing sear 58, the protrusion 60 becomes more tightly engaged with the protrusion 54 of hammer 52, meaning that a longer pull is necessary to disengage those two components. As the adjustable screw 68 is loosened, the protrusion 60 becomes less tightly engaged with the protrusion 54 of hammer 52, meaning that a shorter pull is necessary to disengage those two components. However, if the adjustable screw 68 is loosened too much, the protrusion 60 can disengage from the protrusion 54 of hammer 52 completely, which is not desirable.

Figure 17:
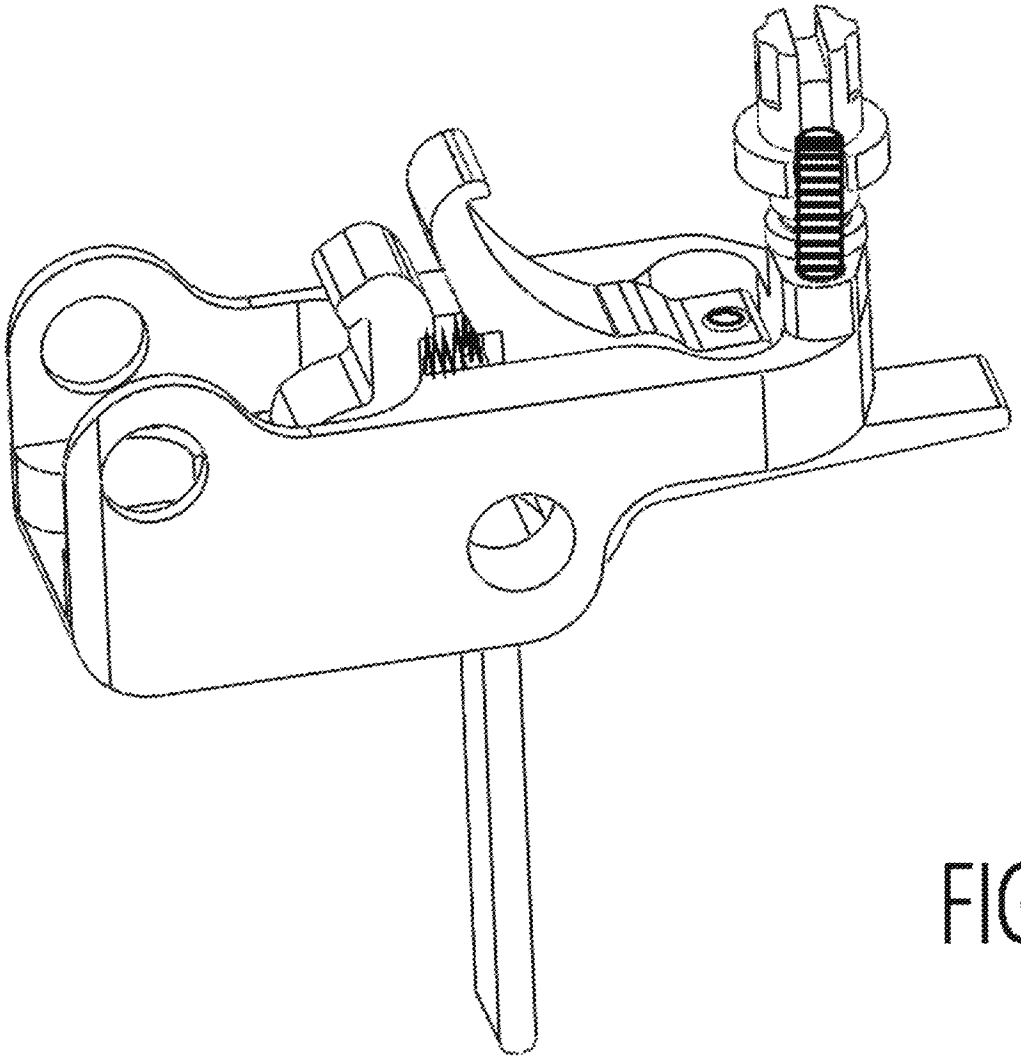
FIG. 17 is an isometric view of the second example.
Figure 18:
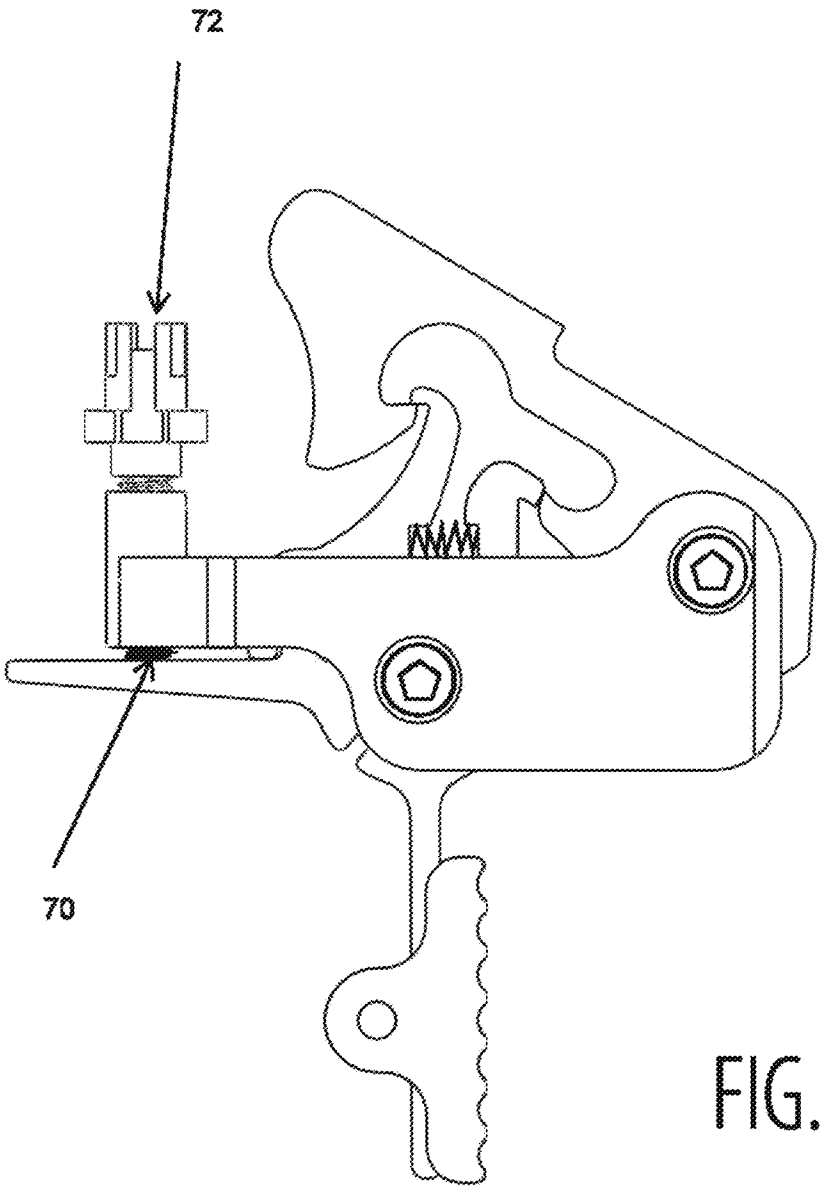
FIG. 18 is an isometric view of the second example.

The trigger system can also have a system for adjusting the trigger pull force that is required to fire the weapon, as disclosed in U.S. Pat. No. 11,796,270. That system for adjusting the trigger pull force, including the adjustable screw, is shown in FIG. 17-18.

The trigger system thus has a "dual-adjustment" capability—a user can adjust both the trigger pull force and the tightness of the firing sear to desired settings, which is very useful in competition and other settings.

The Figures show only certain portions of the weapon that are necessary for illustrating the described system, and the full weapon is not depicted.

In the foregoing Detailed Description, various features can be grouped together in several example embodiments for the purpose of streamlining the disclosure. This method of disclosure is not to be interpreted as reflecting an intention that any embodiment requires more features than are expressly recited in the corresponding claim. Rather, inventive subject matter may lie in less than all features of a single disclosed example embodiment. Thus, the present disclosure shall also be construed as implicitly disclosing any embodiment having any suitable set of one or more disclosed or claimed features (i.e., a set of features that are neither incompatible nor mutually exclusive) that appear in the present disclosure, including those sets that may not be explicitly disclosed herein.

The scope of the originally filed claims does not necessarily encompass the whole of the subject matter disclosed herein. The originally filed claims are hereby incorporated into the Detailed Description, with each claim standing on its own as a separate disclosed embodiment. The scope of subject matter encompassed by each claim shall be determined by the recitation of only that claim.

The conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or," "only one of," or similar language; or (ii) two or more of the listed alternatives are mutually exclusive within the particular context, in which case "or" would encompass only those combinations involving non-mutually-exclusive alternatives. The words "comprising," "including," "having," and variants thereof, wherever they appear, shall be construed as open ended terminology, with the same meaning as if the phrase "at least" were appended after each instance thereof.

If any one or more disclosures are incorporated herein by reference and such incorporated disclosures conflict in part or whole with, or differ in scope from, the present disclosure, then to the extent of conflict, broader disclosure, or broader definition of terms, the present disclosure controls. If such incorporated disclosures conflict in part or whole with one another, then to the extent of conflict, the later-dated disclosure controls.

What is claimed:

1. A trigger assembly for a weapon comprising:

a trigger housing;

a pivot arm configured to be pushed by a first spring toward a side of the trigger housing facing a front side of the weapon, wherein the pivot arm has a first protrusion;

a disconnector coupled to the pivot arm, wherein the disconnector includes a second protrusion that is configured to be pushed away from the pivot arm by a second spring;

a firing pin release configured to be pushed by a third spring toward a top side of the trigger housing, wherein the firing pin release has a third protrusion and a fourth protrusion;

a pin coupled to the pivot arm;

a trigger coupled via a linkage to the pin and configured to be pulled to cause the pin to be moved away from the front side of the weapon; and a firing pin, wherein the trigger assembly is configured to have:

(1) a first position before the trigger has been pulled, in which the first protrusion is wedged against the third protrusion, thereby causing the firing pin release to prevent the firing pin from sliding to fire the weapon;

(2) a second position after the trigger has been pulled, in which the first protrusion is no longer wedged against the third protrusion and the firing pin release has pivoted away from the top side of the trigger housing to allow the firing pin to fire the weapon; and (3) a third position after the trigger has been pulled to fire the weapon and before the trigger has been released, in which the firing pin has recoiled and the second protrusion is wedged against the fourth protrusion, thereby causing the firing pin release to prevent the firing pin from sliding to fire the weapon.

* * * * *